US008305181B2

(12) United States Patent
Kitagawa et al.

(10) Patent No.: US 8,305,181 B2
(45) Date of Patent: Nov. 6, 2012

(54) CHIP INDUCTOR AND MANUFACTURING METHOD THEREOF

(75) Inventors: Masaki Kitagawa, Nagano (JP); Yukiko Ohta, Nagano (JP); Miho Kawasaki, Nagano (JP)

(73) Assignee: KOA Corporation, Ina-shi (JP)

( * ) Notice: Subject to any disclaimer, the term of this patent is extended or adjusted under 35 U.S.C. 154(b) by 84 days.

(21) Appl. No.: 12/995,845

(22) PCT Filed: Jun. 3, 2009

(86) PCT No.: PCT/JP2009/060126

§ 371 (c)(1),
(2), (4) Date: Dec. 2, 2010

(87) PCT Pub. No.: WO2009/148072

PCT Pub. Date: Dec. 10, 2009

(65) Prior Publication Data

US 2011/0128107 A1 Jun. 2, 2011

(30) Foreign Application Priority Data

Jun. 5, 2008 (JP) ..... 2008-147725
Sep. 24, 2008 (JP) ..... 2008-244422
Sep. 24, 2008 (JP) ..... 2008-244423

(51) Int. Cl.
*H01F 27/29* (2006.01)
*H01F 27/30* (2006.01)

(52) U.S. Cl. ..... 336/192; 336/208

(58) Field of Classification Search ..... 336/192, 336/65, 208

See application file for complete search history.

(56) References Cited

U.S. PATENT DOCUMENTS 3,117,294 A * 1/1964 Muszynski et al. ..... 336/192
3,521,200 A * 7/1970 Matsushima et al. ..... 333/184

(Continued)

FOREIGN PATENT DOCUMENTS

JP 62-091401 U 6/1987

(Continued)

OTHER PUBLICATIONS

International Search Report of PCT/JP2009/060126, mailing date Aug. 25, 2009.

*Primary Examiner* — Mohamad Musleh
*Assistant Examiner* — Joselito Baisa
(74) *Attorney, Agent, or Firm* — Westerman, Hattori, Daniels & Adrian, LLP

(57) ABSTRACT

To provide a chip inductor, which can make magnetic loss of the inductor element reduced, excellent in electrical property such as high Q etc., and high reliability, which is demanded for use in vehicles. The chip inductor comprises a ferrite core (11) comprising an axial section (11*a*), flange portions (11*b*) disposed at both ends of the axial section, and concavities (11*c*) opened for direction of the axial section on at least one face of the flange section; an internal electrode (13) consisting of metallic plate having a notch portion at axial section side, the internal electrode fixed on the upper face of the flange section having the concavity; and a winding (12) wound around the axial section of the ferrite core; wherein an end portion of the winding (12*a*) comes in contact to a side of the concavity, which faces to the axial section, comes in contact to the notch portion of the internal electrode, and is fixed on upper face of the internal electrode.

13 Claims, 7 Drawing Sheets

U.S. PATENT DOCUMENTS

| | | | | | |
|---|---|---|---|---|---|
| 3,533,054 | A | * | 10/1970 | Mancini et al. | 439/733.1 |
| 3,585,553 | A | * | 6/1971 | Muckelroy et al. | 336/192 |
| 3,663,914 | A | * | 5/1972 | Lane | 336/192 |
| 4,166,265 | A | * | 8/1979 | Reynolds et al. | 336/192 |
| 4,382,269 | A | * | 5/1983 | Kato | 360/121 |
| 5,457,872 | A | * | 10/1995 | Sakata et al. | 29/605 |
| 6,005,465 | A | * | 12/1999 | Kronenberg et al. | 336/192 |
| 6,525,635 | B2 | * | 2/2003 | Murata et al. | 336/83 |
| 6,535,095 | B2 | * | 3/2003 | Aoki et al. | 336/83 |
| 6,727,792 | B2 | * | 4/2004 | Amada et al. | 336/192 |
| 7,081,804 | B2 | * | 7/2006 | Kitagawa | 336/200 |
| 7,084,730 | B2 | * | 8/2006 | Kitagawa | 336/200 |
| 2005/0174205 | A1 | | 8/2005 | Kitagawa | |

FOREIGN PATENT DOCUMENTS

| | | | |
|---|---|---|---|
| JP | 63-187312 | U | 11/1988 |
| JP | 5-033506 | U | 4/1993 |
| JP | 9-219318 | A | 8/1997 |
| JP | 2003-151837 | A | 5/2003 |
| JP | 2005-223147 | A | 8/2005 |
| JP | 2005-228827 | A | 8/2005 |

* cited by examiner

[FIG. 1A]
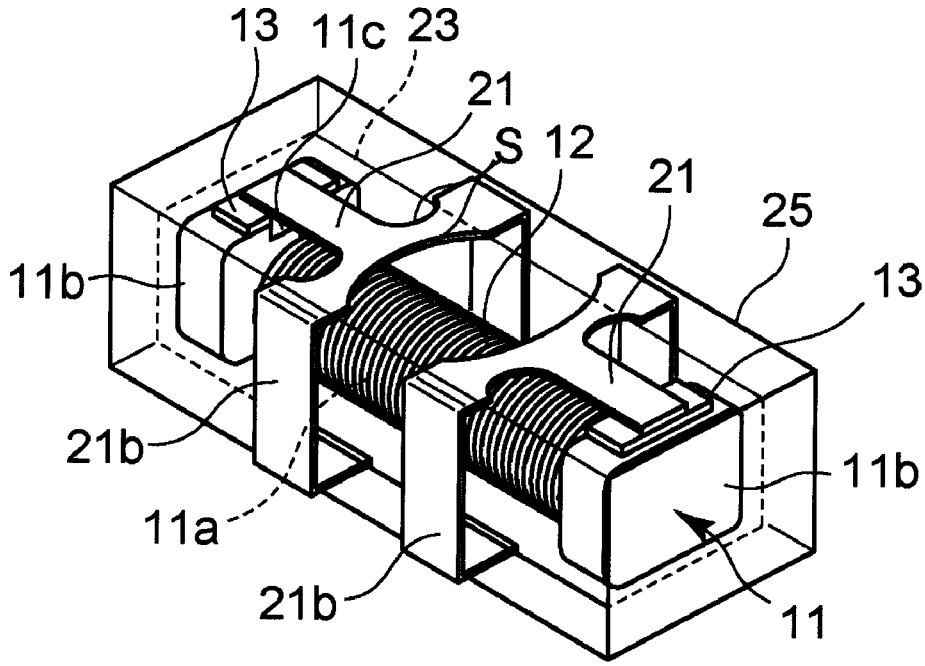
[FIG. 1B]
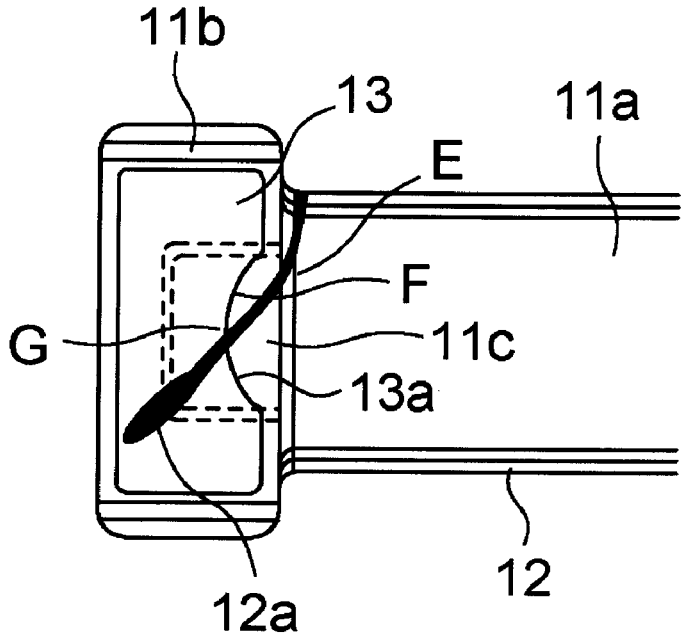

[FIG. 1C]
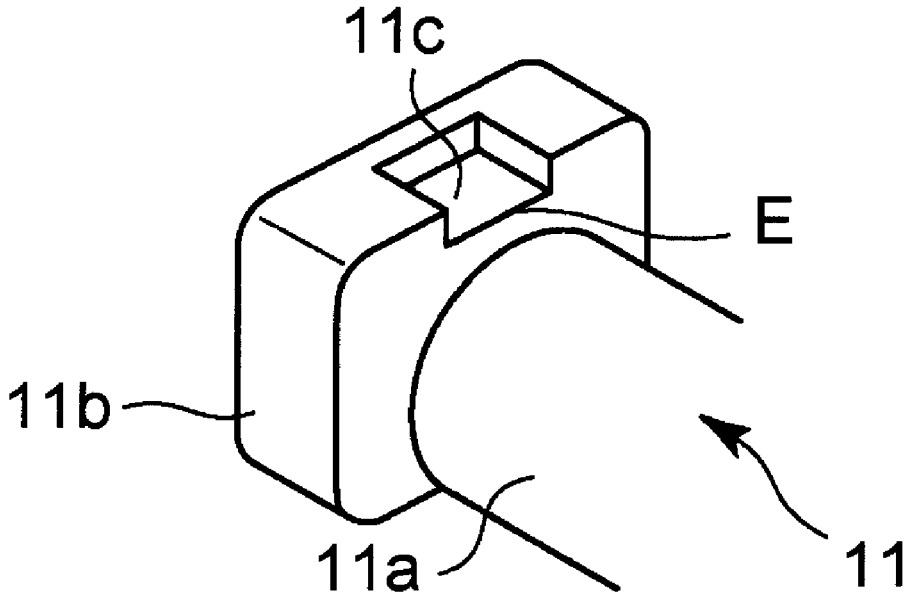

[FIG. 2A]
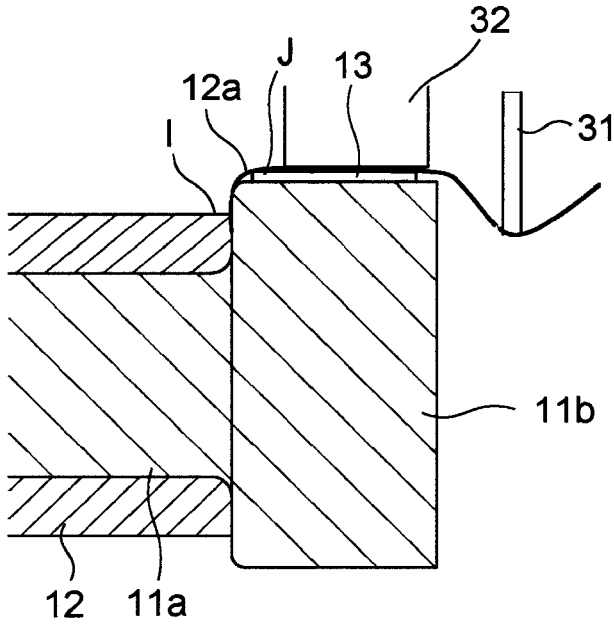
[FIG. 2B]
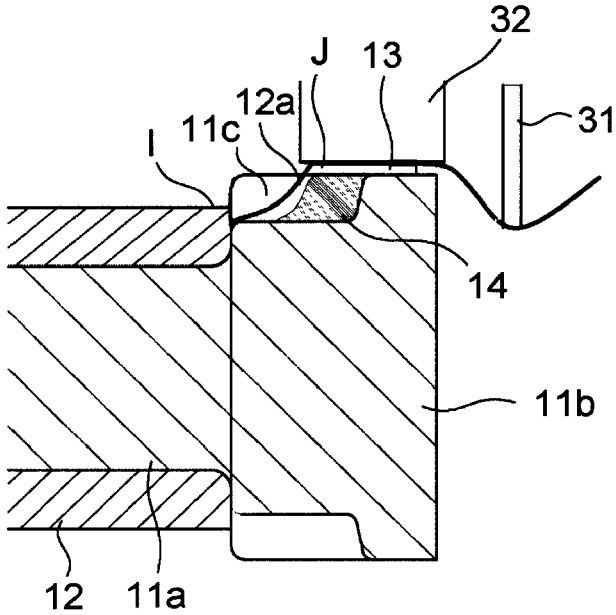

[FIG. 3A]
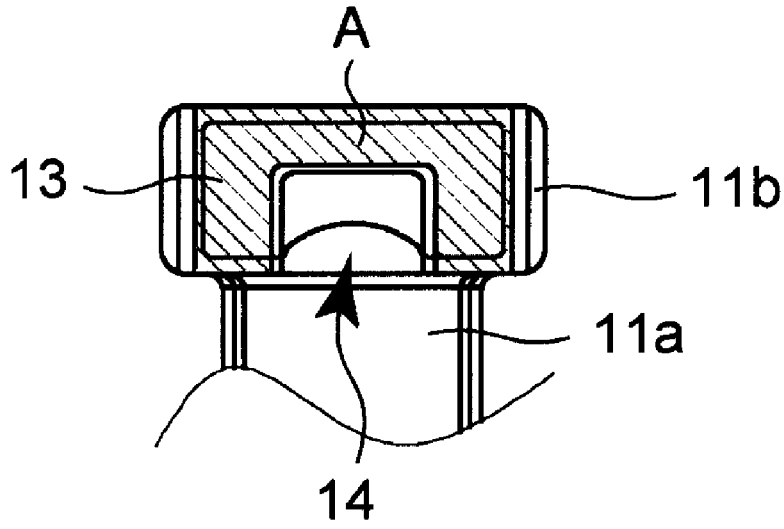
[FIG. 3B]
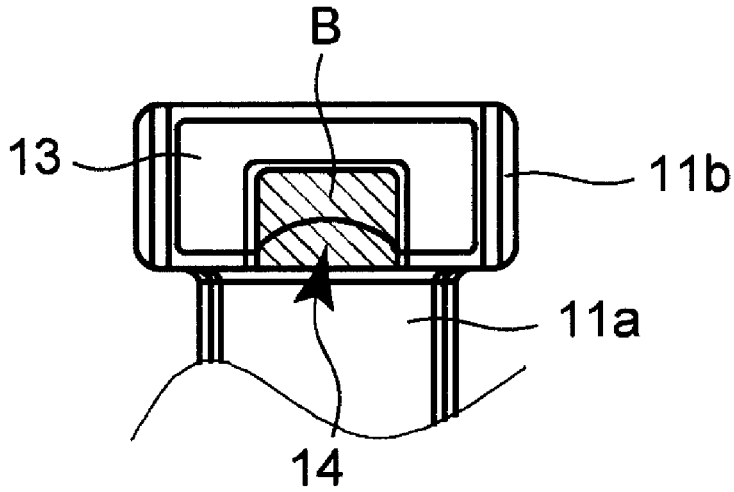

[FIG. 4A]
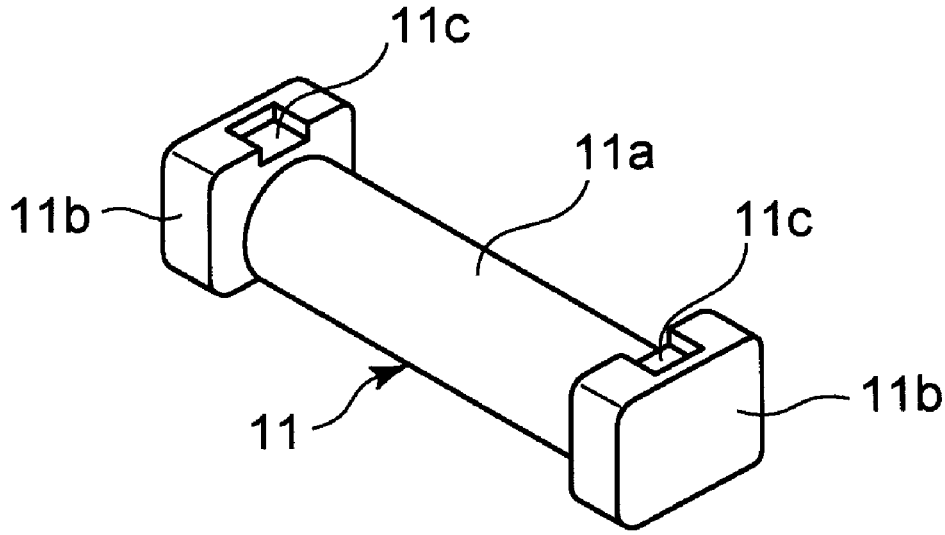
[FIG. 4B]
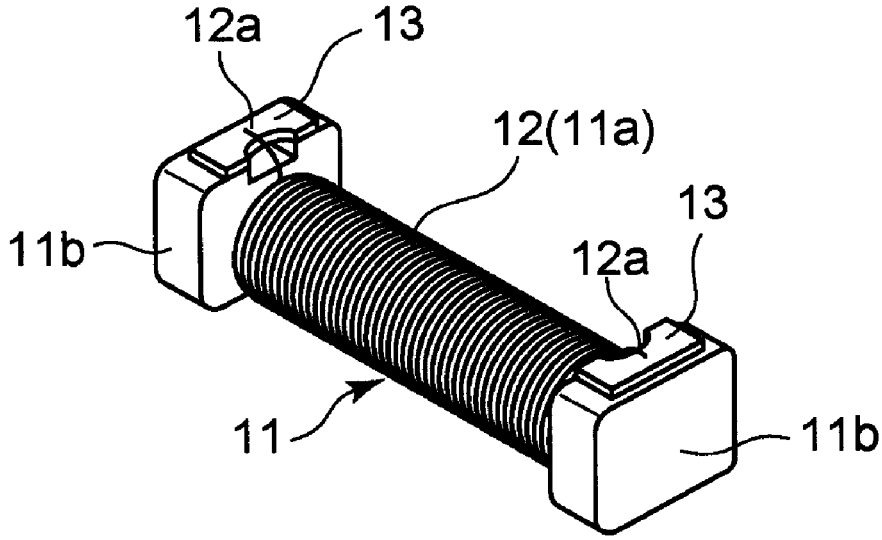

[FIG. 4C]
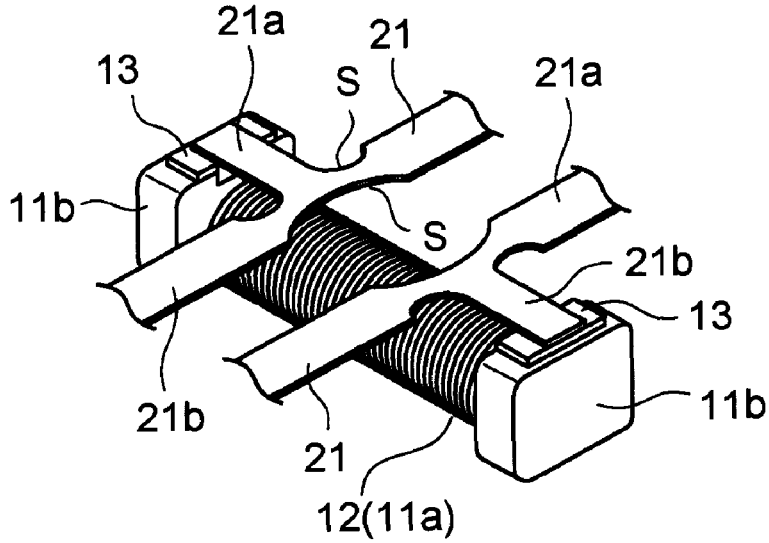
[FIG. 4D]
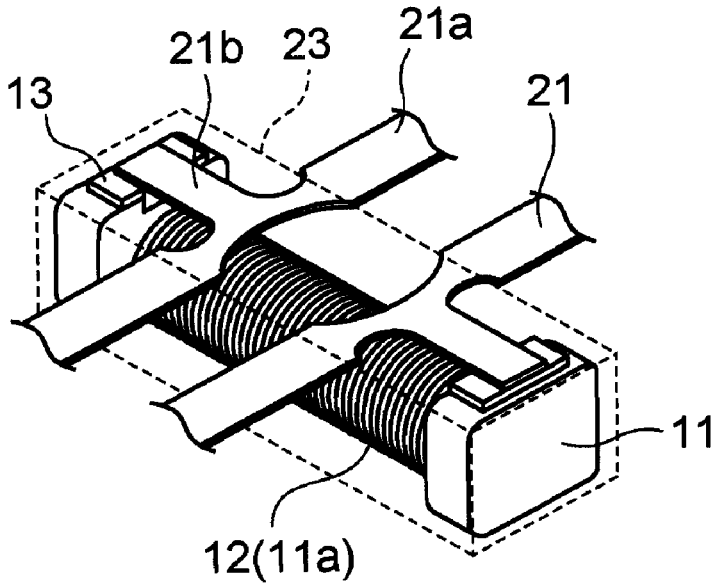

[FIG. 4E]
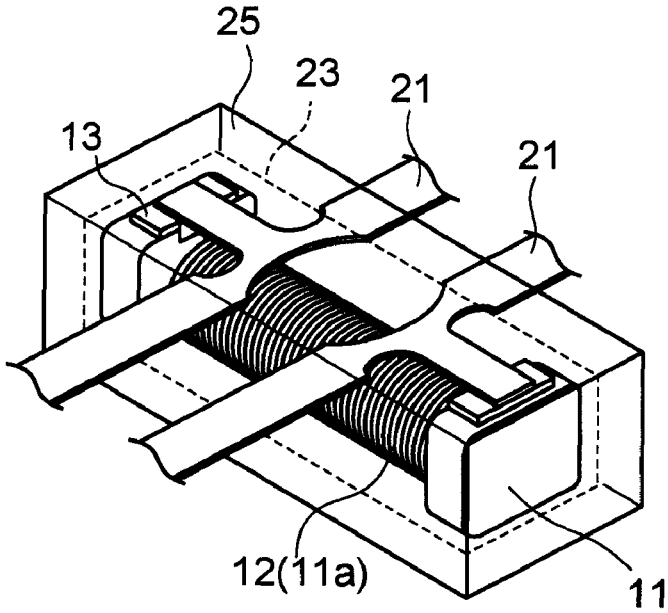
[FIG. 4F]
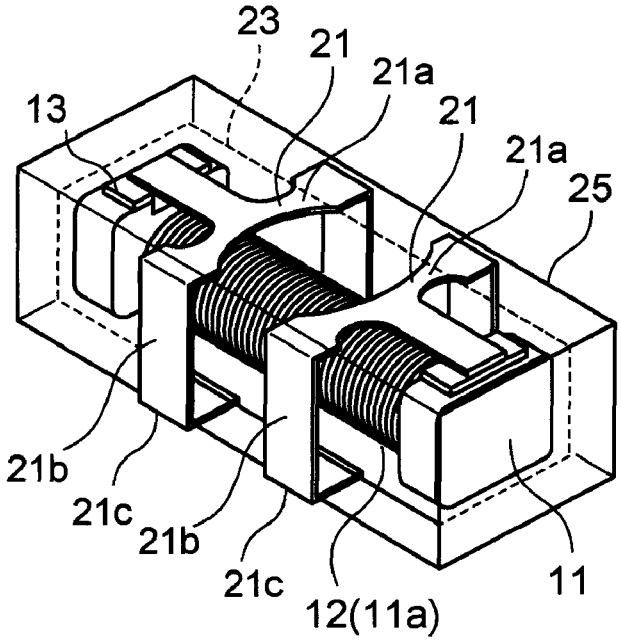

CHIP INDUCTOR AND MANUFACTURING METHOD THEREOF

TECHNICAL FIELD

The present invention relates to a winding-type inductor element that has winding around ferrite core axial section, and that has comparatively large inductance value, and particularly relates to a surface-mountable chip inductor.

BACKGROUND ART

In the past, a winding-type inductor element that has winding around ferrite core, and that has comparatively big inductance value, is known. These elements are made by preparing ferrite core that comprises a columnar or pillar ferrite core section and flange sections provided at both ends of the core section, giving winding to ferrite core axial section, and fixing both ends of winding to electrodes provided at both flange sections so as to make these electrodes surface-mountable. (Japanese laid-open patent publication H09-213198).

Also, an inductor element is known, which is made by giving winding to ferrite core axial section, fixing both ends of winding to inner electrodes provided at both flanges, enclosing the whole with exterior resin (mold resin), extending outer electrodes, which are connected to inner electrodes, from lower side in side face of mold resin body and bending the outer electrodes along bottom face to be surface-mountable (Japanese laid-open patent publication 2005-223147).

DISCLOSURE OF INVENTION

Problems to be Solved

However, for instance, in case that these elements are used in vehicles, there might be exposed in the state of extremely low temperature at coldest season to high temperature at hottest season, and exposed to thumping vibration and impact condition, thus, these elements are demanded to endure these environments and to execute necessary operations at high stability and reliability.

The present invention has been made basing on the circumstances. It is therefore an object of the present invention to provide a chip inductor, which can make magnetic loss of the inductor element reduced, excellent in electrical property such as high Q etc., and high reliability, which is demanded for use in vehicles.

Means for Solving Problems

The chip inductor of the present invention is characterized by a ferrite core comprising an axial section, flange portions disposed at both ends of the axial section, and concavities opened for direction of the axial section on at least one face of the flange section; an internal electrode consisting of metallic plate having a notch portion at axial section side, the internal electrode fixed on the upper face of the flange section having the concavity; and a winding wound around the axial section of the ferrite core; wherein an end portion of the winding comes in contact to a side of the concavity, which faces to the axial section, comes in contact to the notch portion of the internal electrode, and is fixed on upper face of the internal electrode.

Further, characterized in that the internal electrode is fixed on upper face of the flange section having the concavity with adhesive, and a portion of the adhesive is filled to the concavity, and the internal electrode consisting of metallic plate is fixed on upper face of the flange section by thin plane and thick plane of the adhesive.

Further, characterized in that the ferrite core and the winding are covered by rubber resin and enclosed in the mold resin body.

BRIEF DESCRIPTION OF DRAWINGS

FIG. 1 is a perspective view of a chip inductor according to an embodiment of the present invention, which sees through inside thereof, where overall composition example is shown.

FIG. 1B is an enlarged upper view of upper face of ferrite core flange section and the peripheral thereof.

FIG. 1C is an enlarged perspective view of ferrite core flange section and the peripheral thereof.

FIG. 2A is a cross-sectional view explaining fixation method of an end portion of the winding of conventional structure for comparing to structure by present invention.

FIG. 2B is a cross-sectional view explaining fixation method of an end portion of the winding according to structure by present invention for comparing to conventional structure.

FIG. 3A is an upper view of ferrite core flange section and vicinity thereof, and A shows region of thin adhesive.

FIG. 3B is an upper view of ferrite core flange section and vicinity thereof, and B shows region of thick adhesive.

[FIG. 4A] FIGS. 4A-4F shows manufacturing process of chip inductor according to present invention, and FIG. 4A is a perspective view of the ferrite core.

[FIG. 4B] Similarly, FIG. 4B is a perspective view that shows a stage where internal electrodes and winding are formed to the ferrite core.

[FIG. 4C] Similarly, FIG. 4C is a perspective view that shows a stage where external electrodes are bonded to the internal electrodes.

[FIG. 4D] Similarly, FIG. 4D is a perspective view that shows a stage where core portion with winding is covered by rubber resin.

[FIG. 4E] Similarly, FIG. 4E is a perspective view that shows a stage where further covered by mold resin body.

[FIG. 4F] Similarly, FIG. 4F is a perspective view that shows a stage where external terminals are bent.

BEST MODE FOR CARRYING OUT THE INVENTION

Embodiments of the present invention will be described below with referring to FIG. 1A-FIG. 4F. Like or corresponding parts or elements will be denoted and explained by the same reference characters throughout figures.

FIG. 1 shows overall composition example of the chip inductor according to an embodiment of the present invention. The chip inductor is provided with a ferrite core 11, which comprises columnar or pillar axial section 11*a* and flange sections 11*b*,11*b* at both ends thereof, and a winding 12 in external resin (mold resin body) 25, where the winding 12 is wounded around the axial section 11*a*, and both ends of the winding 12 are fixed to internal electrodes 13 formed on the flange sections 11*b*. Internal electrode 13 that tin plating etc. were given to copper plate, is fixed on upper face of the flange portion 11*b* of the ferrite core with adhesive, and both ends 12*a* of winding 12 are connected to the internal electrodes 13 by thermo-compression bonding.

An end of metallic plate (external electrode) 21 such as copper of T shaped is connected to internal electrode 13. Both other ends of metallic plate 21 extend from upper part of side face of mold resin body 25, and are bent and disposed along side face and bottom face of mold resin body 25, that is to become terminal portions 21*b*. Metallic plate (external electrode) 21 comprises curve-shaped notch part S at vicinity of intersection of sides of T character. Solder or tin plating is given if necessary on surface of terminal portions 21*b* so as to be electrode terminal portions for surface mounting. Since this electrode terminal portion is extending to upper part (upper position of core with winding) along side face of the mold resin body, the role as spring material and cushion material can be played, the stress according to vibration, impact, expansion, and shrinkage applied to mounting board can be absorbed, and application of stress to the core portion with winding can be reduced.

Ferrite core 11, winding 12 around ferrite core axial section 11*a*, and a portion of metal plate 21 are covered with rubber resin 23 consisting of soft silicone resin. Mold resin body 25 is hard exterior resin consisting of thermosetting resin such as epoxy resin or thermoplastic resin such as liquid crystalline polymers, and a part of metallic plate 21 of T character shaped is covered, and the whole of rubber resin 23 that covers ferrite core 11, winding 12, etc. is covered. Therefore, since external electrode terminal portion 21*b* is retained with hard exterior resin and the core with winding portion is covered by soft rubber resin 23, the stress by vibration, impact or temperature change applied from outside can be absorbed by soft rubber resin 23, and the application of stress to the core with winding portion can be reduced. Further, though mold resin body 25 is described to be transparent in each figure for convenience of explanation, mold resin body 25 is actually a black etc., and the inside cannot be seen visually.

In this inductor element, a concavity 11*c* opened for direction of axial section 11*a* is formed on upper face of ferrite core flange section 11*b* as shown in FIG. 1B and FIG. 1C, and internal electrode 13 consisting of metallic plate is fixed on upper face of the flange section 11*b* with adhesive. As for internal electrode 13, curve-shaped notch part 13*a* is formed on ferrite core axial section 11*a* side, and the curved shape of notch part 13*a* does circular arc F (see FIG. 1B).

A size of upper face of ferrite core flange section is about 1.8 mm width×0.8 mm length axially, and here the concavity 11*c* of about 0.85 mm width×0.6 mm length axially×0.2 mm depth is formed. And the internal electrode 13 consisting of copper plate of about same size with upper face of the flange section 11*b* with tin plated layer of about 0.1 mm in thickness is fixed with an adhesive. The wire of winding 12 is copper wire of about 40 microns in diameter and an insulating coating is given to its surface.

End portion of winding (wire) 12*a* comes in contact to side E of the concavity 11*c*, which faces axial section 11*a*, comes in contact to vicinity of top G of circular arc F of curve-shaped notch part 13*a* of the internal electrode 13, and, in addition, is fixed on upper face of internal electrode 13 (see FIG. 1B). Since curve-shaped notch part 13*a* has the shape of circular arc, and end portion of winding (wire) 12*a* is fixed to internal electrode 13 by the above-mentioned path, it can lead wire 12*a* at a gradual angle from finishing (I) of winding 12 to fixation position on internal electrode 13.

FIG. 2A and FIG. 2B are figures where fixation method of the end portion of winding by conventional structure and by present invention structure is compared and described.

As shown in FIG. 2A, according to conventional structure, wire 12*a* rises from finishing (I) of winding 12, and be bent in acute angle of abbreviate 90°, while being pulled to tension treatment device 31, pulse-like pressure and heat are applied by thermo compression bonding by heater chip 32, and wire 12*a* is fixed to internal electrode 13 and it is cut. In this case, because of thermo-compression bonding, heat about 450° C. from heater chip 32 is applied, since distance of tip J of internal electrode 13 and finishing (I) of winding 12 is short, there is a problem of generating phenomenon of rare short that melts insulation film of winding 12 to cause short-circuited.

On the other hand, as shown in FIG. 2B, according to structure of present invention, because of being provided with concavity 11*c* at ferrite core flange portion 11*b* opened in direction of axial section 11*a*, and curve-shaped notch part 13*a* on axial section 11*a* side of internal electrode 13 bonded on ferrite core flange portion 11*b*, enough distance is obtained from the part of internal electrode 13 that becomes high temperature when wire 12*a* is connected, to the finishing (I) of winding 12 of ferrite core axial section.

Therefore, it becomes difficult to generate rare short, which is caused by insulation coating being melt, because heat of about 450° C., which is generated when wire 12*a* is connected to internal electrode 13 by thermo-compression bonding, is not transmitted even to winding 12, which is wound around ferrite core axial section. Moreover, since curve-shaped notch part 13*a* is provided at axial section side of the internal electrode, it makes incidence angle of wire 12*a* to be gradual, and by guiding wire input position at a fixed position of at vicinity of top G of circular arc F, the difference of thermo-compression bonding of the wire can be lost.

Since a portion of adhesive 14 is filled to concavity 11*c*, and upper face of flange section 11*b* is bonded to internal electrode 13 consisting of metallic plate by adhesive 14, the internal electrode 13 is fixed on flange section 11*b* by thin plane and thick plane of the adhesive 14. As a result, part A shown by hatching in FIG. 3A becomes a good thermal conductivity portion since thickness of the adhesive is thin, and part B shown by hatching in FIG. 3B becomes a poor thermal conductivity portion since thickness of the adhesive is thick. In this example, the thickness of the portion where the adhesive is thin is about ten microns, and the thickness of the portion where the adhesive is thick (depth of the concavity) is about 220 microns. Moreover, the thickness of the internal electrode is about 0.1 mm.

According to peel test (destructive test) result of the internal electrode by the present inventors etc., the interfacial debonding (it peels off by the interface of the adhesive and the adhered surface, and the adhesive function is not accomplished) has happened by heat concentration occurring in the point where the adhesive is thin. While, the portion where the adhesive is thick becomes a cohesive destruction (peel in the adhesive). Therefore, by forming the concavity 11*c* in ferrite core flange section 11*b*, which has junction plane with the internal electrode, and by forming thick and thin portions of adhesive 14, and by forming good and bad places of thermal conductivity, strength degradation of the adhesive by heat, when end of winding 12*a* is connected, can be reduced, and enough strength of the adhesive can be retained after metallic plate to be external electrode is installed.

Entire flange portion 11*b* of ferrite core 14 including internal electrode 13, entire winding 12 wound around axial section 11*a* of ferrite core 14, entire conducting portion 21*a* of metallic plate 21, and portions of terminal portion 21*b* is covered with rubber resin 23 consisting of soft silicon resin. The softer the hardness of rubber resin 23 is, the higher the cushion effect is. The hardness of the rubber resin is preferably below 25 in shore A hardness. and in particular, about ten in shore A hardness is preferable.

Molding resin body 25 is a hard exterior resin consisting of thermosetting resin such as epoxy resin or thermoplastic resin such as liquid crystalline polymers, and encloses upper face portion A of metallic plate 21 of T character shape, and encloses whole of rubber resin 23 that encloses flange portion 11*b*, ferrite core 11, winding 12, and so on.

Therefore, in temperature cycling test etc., even if ferrite core 11 and mold resin body 25 is thermally expanded or shrunk, stress applied to ferrite core 11 and winding 12 can be absorbed with cushioning properties of rubber resin 23, and fatigue of winding and ferrite core portion by temperature cycling can be reduced. Moreover, even if high impact is applied to mold resin body 25 of the exterior, the stress applied to ferrite core 11 and winding 12 can be absorbed by cushioning properties of the rubber resin 23. As a result, inductance temperature coefficient can be reduced, moreover, the inductance variation in impact test etc. can be reduced, and stability and reliability of the chip inductor can be improved.

Next, manufacturing process of the chip inductor will be described referring to FIG. 4A through FIG. 4F. First, ferrite core 11, which is provided with columnar or pillar axial section 11*a*, flange sections 11*b*,11*b* at both ends thereof, and concavity 11*c*, which is opened for direction of axial section 11*a* on at least one face of the flange section, is prepared as shown in FIG. 4A. In the ferrite core 11 as shown in the drawing, since concavities 11*c* and 11*c* are opened to direction of axial section 11*a* on top and bottom of flange section 11*b* and 11*b*, internal electrode 13 can be disposed to a face that becomes upper of the flange section by the fabrication step.

Next, internal electrode 13 is fixed to each upper face of flange sections 11*b*,11*b* with adhesive as shown in FIG. 4B. The internal electrode 13 is made to have tin plated layer on copper plate in the embodiment. The adhesive uses epoxy resin of high thermo-stability. The adhesive is filled to concavity 11*c*, and is coated on upper face of flange section 11*b* so as to fix the internal electrode 13 consisting of metallic plate, and the internal electrode 13 is bonded by heating and drying on upper face of the flange section 11*b*. As a result, internal electrode 13 consisting of metallic plate is fixed on upper face of the flange section 11*b* by thin plane of adhesive on upper face of flange section and thick plane of adhesive on upper face of concave portion.

Next, winding 12 is given to axial section 11*a* in ferrite core 11. Wire 12*a* of end of the winding comes in contact to side E of concavity 11*c* where it faces axial section 11*a*, and comes in contact in addition to top G of arc F of curved shape notch part 13*a* of the internal electrode, and is fixed by thermo-compression bonding on the internal electrode 13 (See FIG. 1B).

As shown in FIG. 2B, fixing of the end of winding is carried out by pulling wire 12*a* with using wire pulling tool 31*a*, by applying pressure with heater chip (heat source) 32, and by applying heat of about 450° C. by about 0.3 seconds pulse-likely. In this case, as shown in FIG. 1B, since the internal electrode 13 has curve-shaped notch part 13*a*, positioning of end portion of winding is easily made so that wire 12*a* pass through top G of circular arc F, and as a result, wire 12*a* can be fixed without the difference.

Though bonding of wire 12*a* on the internal electrode 13 is carried out by thermo-compression bonding by applying heat of about 450° C. , as above-mentioned, since a portion of adhesive 14 is filled to concavity 11*c* of ferrite core flange section, and internal electrode 13 consisting of metallic plate is fixed to flange section 11*b* through thin plane and thick plane of adhesive, it is just as above-mentioned that strength degradation of the adhesive by heat can be reduced.

Moreover, since concavity 11*c* in ferrite core flange section 11*b* and curve-shaped notch portion 13*a* at a side of axial section 11*a* in the internal electrode 13 is provided, distance from circular arc top G of internal electrode 13 to winding 12 around axial section can be obtained. Therefore, heat of about 450° C. generated when wire 12*a* is connected to the internal electrode by thermo-compression bonding is not transmitted to winding 12, which is wound around to ferrite core axial section, and it is as above-mentioned that the rare short that is caused by insulation coating melting becomes difficult to generate.

Next, as shown in FIG. 4C, lead frame (metallic plate) 21 that becomes an external electrode is prepared, an end portion of the lead frame (metallic plate) 21 is fixed by soldering etc. on internal electrode 13, and a bar portion 21*a* of the lead frame (metallic plate) is disposed at a position above the winding 12. The degradation of adhesive 14 that fixes internal electrode 13 to flange section 11*b* is not caused though the heat of about 350° C. is applied to internal electrode 13 at this time.

Lead frame (metallic plate) 21 has T character shape, and is provided with curve-shaped notch part S in neighborhood at intersection of sides of the T character. That is, the lead frame 21 comprises bar-shape portion 21*a* and terminal portion 21*b*, which intersects and connects to the bar-shape portion, and by providing arc-shaped notch portion S at neighborhood of T-character intersecting portion so as to make width of external electrode 21 substantially narrow, running away of heat can be prevented when soldering.

Next, as shown in FIG. 4D, ferrite core 11, winding 12 wounded around the ferrite core, and a portion of lead frame (metallic plate) 21 is covered by rubber resin 23. And, as shown in FIG. 4E, winding and core portion, which is covered by rubber resin 23, and a portion of lead flame (metallic plate) 21 is further enclosed by mold resin body by insert molding etc. Under such condition, terminal portion 21*b* where lead frame (metallic plate) 21 is not enclosed, extends from upper part in side face of mold resin body 25.

And, as shown in FIG. 4F, unnecessary portion of the lead frame is lead-cut, terminal portion 21*b* of metallic plate 21 extending from mold resin body, which becomes a lead terminal, is bent along side face and bottom face of mold resin body 25, and terminal portion 21*c* for surface mounting is formed at bottom face of the mold resin body. In addition, by giving solder plating or tin plating etc., an inductor element shown in FIG. 1A is completed.

In above embodiments, an example of forming winding 12 after fixing internal electrode 13 on ferrite core flange portion 11*b* has been described, however internal electrode 13 may be fixed on ferrite core flange portion 11*b* and end portion 12*a* of winding 12 may be fixed on internal electrode 13 after forming winding 12.

Although an embodiment of the present invention has been described above, however the present invention is not limited to the above embodiment, and various changes and modifications may be made within scope of technical concept of the present invention.

Industrial Applicability

The present invention can be suitably applicable for a chip type inductor element for surface mounting, which gives winding around ferrite core axial section and has relatively large inductance value.

The invention claimed is:

1. A chip inductor comprising:

a ferrite core comprising an axial section, flange portions disposed at both ends of the axial section, and concavities opened for direction of the axial section on at least one face of the flange section;

an internal electrode consisting of metallic plate having a notch portion at axial section side, the internal electrode directly fixed on the uppermost face of the flange section above the concavity; and a winding wound around the axial section of the ferrite core;

wherein an end portion of the winding comes in contact to a side of the concavity, which faces to the axial section, comes in contact to the notch portion of the internal electrode, and is fixed on upper face of the internal electrode.

2. The chip inductor according to claim 1, wherein shape of the notch portion is a circular arc, and the end portion of the winding comes in contact to top of the circular arc.

3. The chip inductor according to claim 1, wherein the internal electrode is fixed on upper face of the flange section having the concavity with adhesive.

4. The chip inductor according to claim 1, wherein a portion of the adhesive is filled to the concavity, and the internal electrode consisting of metallic plate is fixed on upper face of the flange section by thin plane and thick plane of the adhesive.

5. The chip inductor according to claim 1, further comprising:

a mold resin body enclosing the ferrite core and the winding; and an external electrode connected to the internal electrode, the external electrode comprising a bar-shape portion disposed at upper position of the winding, and a terminal portion, which is connected to the bar-shape portion, extending from upper part in side face of the mold resin body, and being bent along side face and bottom face of the mold resin body.

6. The chip inductor according to claim 5, wherein the external electrode comprises T character shape, and has curve-shaped notch portions at vicinity of intersection of sides of T character.

7. The chip inductor according to claim 5, wherein the ferrite core and the winding are covered by rubber resin and enclosed in the mold resin body.

8. The chip inductor according to claim 7, wherein hardness of the rubber resin is below 25 in shore A hardness.

9. The chip inductor according to claim 7, wherein the rubber resin consists of silicon resin.

10. A manufacturing method of a chip inductor, comprising:

preparing a ferrite core, which comprises an axial section, flange portions disposed at both ends of the axial section, and concavities opened for direction of the axial section on at least one face of the flange section;

fixing an internal electrode consisting of metallic plate having a notch portion at axial section side on an uppermost face of the flange section above the concavity;

giving a winding around the axial section of the ferrite core, and making an end portion of the winding contact to a side of the concavity, which faces to the axial section, contact to the notch portion of the internal electrode, and fixed on upper face of the internal electrode.

11. The manufacturing method of the chip inductor according to claim 10, further comprising:

preparing a lead frame, fixing an end portion of the lead frame on upper face of the internal electrode, and disposing the lead flame at upper position of the winding;

enclosing the ferrite core, the winding wound around the axial section of the ferrite core, and a portion of the lead flame into a mold resin body, wherein a terminal portion of the lead frame extends at upper part in side face of the mold resin body; and lead-cutting the lead frame, and bending the terminal portion extending from the mold resin body along side face and bottom face of the mold resin body.

12. The manufacturing method of the chip inductor according to claim 11, wherein an adhesive is filled to the concavity of the ferrite core, and the internal electrode is fixed on upper face of the flange section including the upper face of the concavity by the adhesive.

13. The manufacturing method of the chip inductor according to claim 11, wherein the ferrite core and the winding are covered with rubber resin, and enclosed into the mold resin body.

* * * * *